United States Patent [19]

Tasaka

[11] Patent Number: 4,821,684

[45] Date of Patent: Apr. 18, 1989

[54] V-TYPE ENGINE

[75] Inventor: Keisyo Tasaka, Hiroshima, Japan

[73] Assignee: Mazda Motor Corporation, Hiroshima, Japan

[21] Appl. No.: 94,873

[22] Filed: Sep. 10, 1987

[30] Foreign Application Priority Data

Sep. 10, 1986 [JP] Japan ..... 61-213576

[51] Int. Cl.[4] ..... F02M 35/10

[52] U.S. Cl. ..... 123/52 MV; 123/198 R

[58] Field of Search ..... 123/52 MV, 52 M, 55 VF, 123/55 VS, 55 VE, 195 A, 195 R, 198 R

[56] References Cited

U.S. PATENT DOCUMENTS

| | | | |
|---|---|---|---|
| 2,963,007 | 12/1960 | Leach | 123/52 MV |
| 3,730,147 | 5/1973 | Buchwald | 123/195 A |
| 4,129,043 | 12/1978 | Ishikawa | 123/195 A |
| 4,440,120 | 4/1984 | Butler | 123/52 MV |
| 4,448,159 | 5/1984 | Hidaka et al. | 123/55 VE |
| 4,480,600 | 11/1984 | Gill | 123/52 MV |
| 4,577,596 | 3/1986 | Senga | 123/52 MV |

FOREIGN PATENT DOCUMENTS

| | | | |
|---|---|---|---|
| 0020005 | 12/1980 | European Pat. Off. | 123/195 A |
| 0142936 | 11/1980 | Japan | 123/55 VF |
| 0187575 | 11/1983 | Japan | 123/52 M |
| 0196922 | 11/1984 | Japan | 123/55 VE |
| 62-91621 | 4/1987 | Japan . | |

*Primary Examiner*—David A. Okonsky

*Attorney, Agent, or Firm*—Gerald J. Ferguson, Jr.

[57] ABSTRACT

In a V-type engine which is laterally mounted on the vehicle body, an auxiliary mechanism driven by the engine output shaft such as an oil pump for a power steering system is disposed above one of the cylinder banks which is positioned where an engine cover, e.g., a hood is higher as compared with the other cylinder bank.

11 Claims, 4 Drawing Sheets

V-TYPE ENGINE

BACKGROUND OF THE INVENTION

1. Field of the Invention

This invention relates to a V-type engine having a pair of cylinder banks set at an angle to form a V.

2. Description of the Prior Art

As disclosed in Japanese Unexamined Patent Publication No. 59(1984)-565 (U.S. Pat. No. 4,440,120), there has been known a V-type engine structure in which the intake ports for the cylinders in both cylinder banks are formed on the inner side of the respective cylinder banks so that the intake ports in each cylinder bank are directed toward the other cylinder bank, and the intake system connected to the intake ports is disposed in the space between the cylinder banks, thereby making compact the structure of the engine.

On the other hand, an engine must be provided with auxiliary mechanisms such as an alternator, an oil pump for a power steering system, a compressor for an air-conditioner and the like, and such auxiliary mechanisms must be compactly arranged. This is especially difficult when the intake system includes relatively long intake passages and a surge tank in order to obtain the kinetic effect of the intake air.

When the V-type engine is to be laterally mounted relative to the vehicle body, limitations on the arrangement of auxiliary mechanisms change from those when the engine is to be longitudinally mounted due to the limited space in the engine compartment, and it becomes difficult to dispose the auxiliary mechanisms in the same positions Further, arrangement of the auxiliary mechanisms can cause problems with respect to the engine mounting and make it difficult to carry out various operations on the engine, e.g., maintenance of the auxiliary mechanisms and tension adjustment of auxiliary mechanism-driving belts.

The present state of the art is disclosed also in Japanese Unexamined Patent Publication No. 62(1987)-91621 (U.S. patent application Ser. No. 914,662).

SUMMARY OF THE INVENTION

In view of the foregoing observations and description, the primary object of the present invention is to provide a V-type engine which is adapted to be laterally mounted with respect to the vehicle body and in which auxiliary mechanisms are efficiently arranged.

In accordance with the present invention, an auxiliary mechanism driven by the engine output shaft such as an oil pump for a power steering system is disposed above one of the cylinder banks which is positioned where an engine cover, e.g., a hood is higher as compared with the other cylinder bank.

Generally an engine cover, e.g., a hood, is inclined in the longitudinal direction of the vehicle body, and accordingly, when the V-type engine is laterally mounted, the distance between the inner surface of the engine cover and the top surface of the cylinder bank is larger in the cylinder bank which is positioned on the higher side of the engine cover than in the other cylinder bank. Accordingly, by disposing the auxiliary mechanism driven by the engine output shaft above the cylinder bank positioned where the engine cover is higher, the space in the engine compartment can be used more efficiently. Further, by mounting such an auxiliary mechanism on the upper side of the engine, various operations on the engine, e.g., maintenance of the auxiliary mechanisms and tension adjustment of auxiliary mechanism driving belts, are facilitated, and at the same time, mounting of the engine on the vehicle body also is facilitated.

DESCRIPTION OF THE PREFERRED EMBODIMENT

Figure 1:
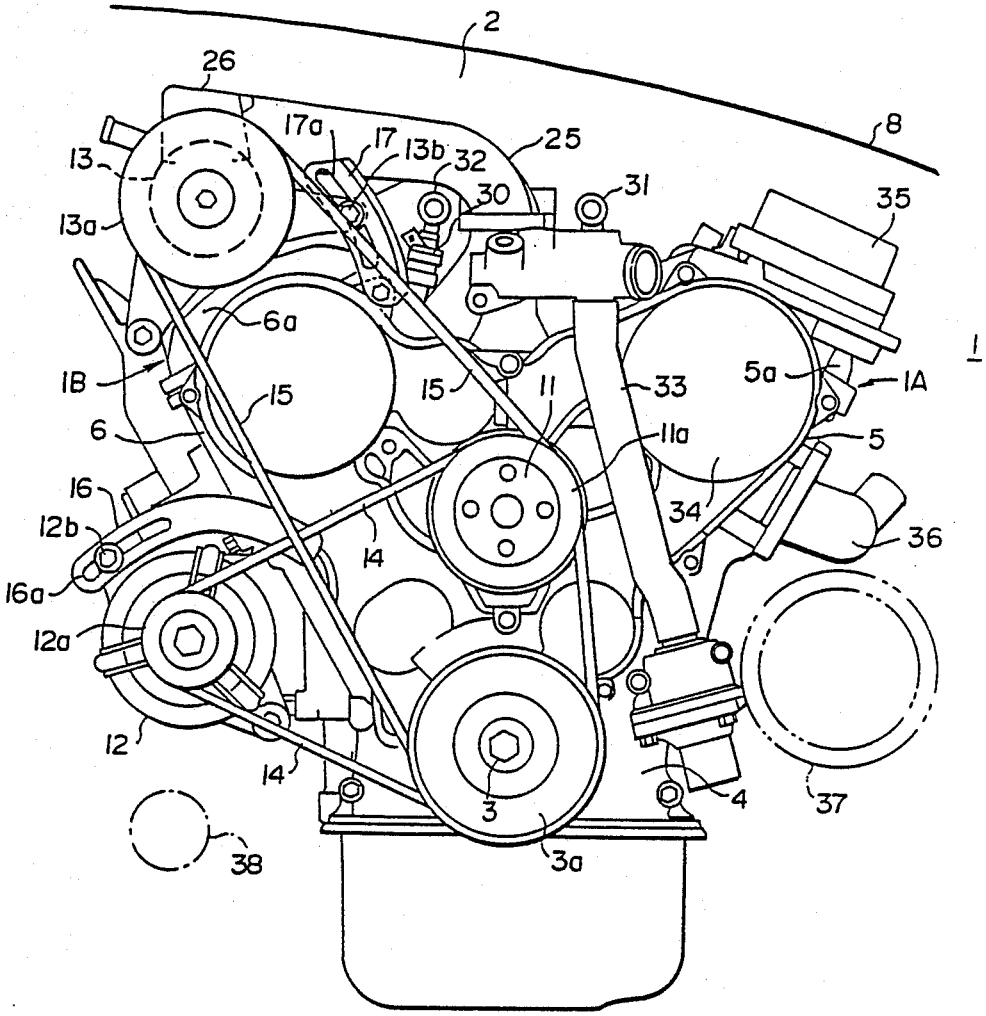
FIG. 1 is a side view of a V-type engine in accordance with an embodiment of the present invention.

In FIG. 1, a V-type engine 1 is laterally mounted in an engine compartment 2 with an engine output shaft 3 being oriented in the transverse direction of the vehicle body. In FIG. 1 the front of the vehicle body is to the right and in FIG. 2 the front of the vehicle body is toward the bottom.

The V-type engine 1 has front and rear cylinder heads 5 and 6 mounted on a cylinder block 4 at an angle to each other to form front and rear cylinder banks 1A and 1B. The front cylinder bank 1A has No. 1, No. 3 and No. 5 cylinders C1, C3 and C5 arranged in a row, and the rear cylinder bank 1B has No. 2, No. 4 and No. 6 cylinders C2, C4 and C6 arranged in a row. A piston 7 is received in each cylinder for sliding motion therein. The positions of cylinders in one cylinder bank are offset axially from the cylinders in the other cylinder bank, and the front cylinder head 5 is displaced to the right of the rear cylinder head 6 as viewed from the front of the vehicle body.

An engine cover (hood) 8 that defines the top of the engine compartment 2 is provided above the engine 1. The engine cover 8 is inclined downward from the rear cylinder bank side to the front cylinder bank side. Each of a pair of side frames 9 extends in the longitudinal direction of the vehicle body on opposite sides of a lower portion of the engine compartment 2 near the engine output shaft 3.

The engine 1 has a water pump 11, an alternator 12 and an oil pump 13 for a power steering system which are driven by the engine output shaft 3. In this particular embodiment, the water pump 11 is disposed on the right side of the cylinder block 4 above the engine output shaft 3, and the alternator 12 is disposed on the rear side of the cylinder block 4 at an intermediate height. The water pump 11 and the alternator 12 are respectively provided with pulleys **11*a* and 12*a*, and are driven by a first V-belt 14 passed around the pulleys 11*a*, 12*a* and a crank pulley 3*a* on the engine output shaft 3. The oil pump 13 for the power steering system is disposed on the right side above the rear cylinder bank 1B the portion of the cover 8 above which is higher than that above the front cylinder bank 1A. The oil pump 13 is provided with a pulley 13*a* and is driven by a second V-belt 15 passed around the pulley 13*a* and the crank pulley 3*a*. The second V-belt 15 is also passed around the pulley 11*a* of the water pump 11** for routing reasons.

The alternator 12 and the oil pump 13 are respectively supported by brackets 16 and 17 having arcuate slots **16*a* and 17*a*, and are fixed thereto by way of mounting portions 12***b* and 13*b* inserted into the slots 16*a* and 17*a*. The tension of the V-belts 14 and 15 can be adjusted by moving the mounting portions 12*b* and 13*b* along the arcuate slots 16*a* and 17*a* of the brackets 16 and 17.

Figure 3:
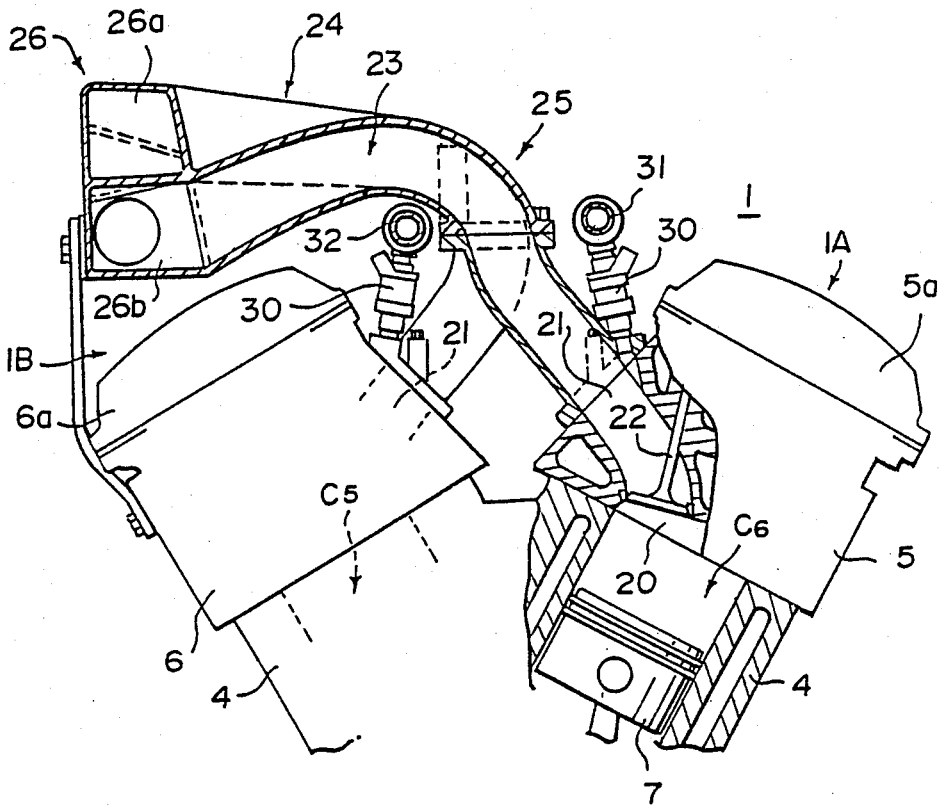
FIG. 3 is a fragmentary cross-sectional view of the V-type engine showing a part of the intake system thereof.

A combustion chamber 20 is formed in each of the cylinders C1 to C6 above the piston 7 and an intake port 21 and an exhaust port (not shown) open to the combustion chamber 20. The intake port 21 is provided with an intake valve 22 and the exhaust port is provided with an exhaust valve (not shown). The intake ports 21 in the front and rear cylinder heads 5 and 6 are formed in the inner wall portions opposed to each other (FIG. 3). Head covers 5*a* and 6*a* are respectively mounted on the front and rear cylinder heads 5 and 6 to cover the valve trains and the like.

Discrete intake passages 23 respectively communicated with the cylinders C1, C3 and C5 in the front cylinder bank 1A and discrete intake passages 24 respectively communicated with the cylinders C2, C4 and C6 in the rear cylinder bank 1B are formed in an intake manifold 25. The upstream ends of the discrete intake passages 23 and 24 are connected to a surge tank 26 disposed above the rear cylinder bank 1B.

The surge tank 26 is in the form of a box elongated in the direction of the engine output shaft 3, i.e., in the transverse direction of the vehicle body. The inner space of the surge tank 26 is divided into upper and lower chambers 26*a* and 26*b* by a partition extending substantially horizontally. The discrete intake passages 23 leading to the cylinders in the front cylinder bank 1A are connected to the lower chamber 26*b* and the discrete intake passages 24 leading to the cylinders in the rear cylinder bank 1B are connected to the upper chamber 26*a*. Thus, the discrete intake passages 23 and 24 for the front and rear cylinder banks 1A and 1B are separately converged. An upstream side intake passage 27 extends from the surge tank 26 rightward away from the oil pump 13 and is bent forward and is connected to a throttle body 28. Further, in a left side portion of the surge tank 26 is provided a control valve 29 for controlling communication between the upper and lower chambers 26*a* and 26*b*. (FIG. 2)

The structure of the intake system described above is advantageous in that the radius of curvature of the discrete intake passages 23 and 24 can be relatively large so that the passage resistance is small, and the effective length of the intake passage can be long enough to obtain an excellent inertia effect of intake air.

A fuel injector 30 is provided in the downstream end portion of each of the discrete intake passages 23 and 24. The injectors 30 provided in the discrete intake passages 23 for the cylinders in the front cylinder bank 1A are connected to a fuel supply pipe 31 and the injectors 30 provided in the discrete intake passages 24 for the cylinders in the rear cylinder bank 1B are connected to a fuel supply pipe 32.

Figure 2:
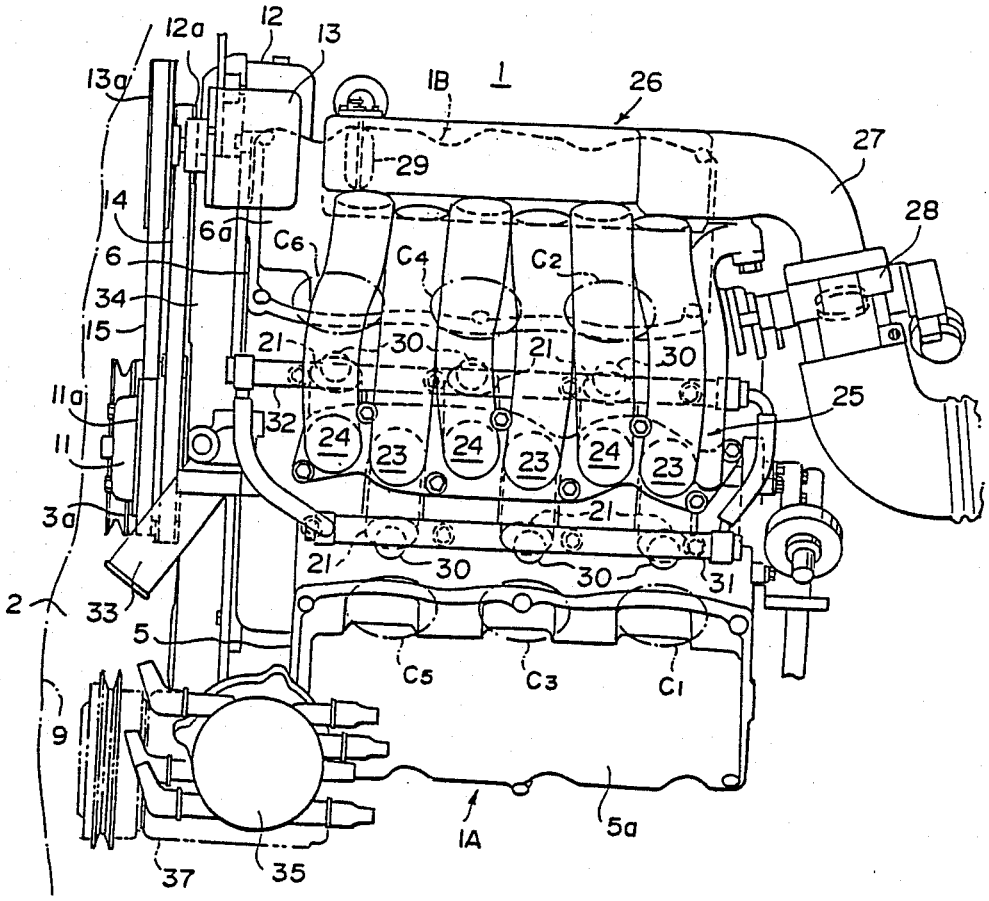
FIG. 2 is a schematic plan view of the V-type engine.

In FIGS. 1 to 3, reference numerals 33 to 36 respectively denote a coolant passage, a timing belt cover, a distributor and an exhaust manifold.

The oil pump 13 for the power steering system is disposed in the space above the rear cylinder bank 1B and beside the surge tank 26 disposed above the rear cylinder bank 1B. Hydraulic pressure is delivered from the oil pump 13 to a power steering system (not shown) through piping. When a compressor 37 for an air-conditioner driven by the engine output shaft 3 is to be provided, the compressor 37 is disposed in front of the cylinder block 4 at the middle of the same as shown by the chained line in FIGS. 1 and 2.

In the case of a front-engine-front-drive car, a drive shaft 38 is disposed on the lower rear side of the engine and no auxiliary mechanism can be disposed there.

In this embodiment, since the oil pump 13 is disposed above the rear cylinder bank 1B and the compressor 37 and the alternator 12 are respectively disposed on the front and rear sides of the cylinder block 4, the size and height of the engine can be minimized. Especially, by disposing the oil pump 13 on the side of the surge tank 26 opposite to the intake passage 27, a V-type engine which has an intake system having desired properties and which can be accommodated in a predetermined space can be realized.

That is, since no intake system or auxiliary mechanism is disposed above the front cylinder bank 1A, the cover 8 may be low above the front cylinder bank. On the other hand, since the cover 8 is high above the rear cylinder bank 1B, the surge tank 26 and the oil pump 13 can be accommodated in the space between the rear cylinder bank 1B and the cover 8 without forcing.

Mounting of the engine 1 can be effected more easily taking into account the relation in size of the engine 1 and the side frame 9 by lifting the engine 1 in a position shifted forward from a predetermined mounting position on the vehicle body and then moving the engine 1 rearward relative to the vehicle body to the mounting position, thereby preventing interference of the engine 1 with the vehicle body when the engine is mounted on the vehicle body.

Further, by mounting the oil pump 13 for the power steering system on an upper part of the engine, the oil pump 13 and the piping for the power steering system can be free of the influence of heat from the exhaust manifold. This facilitates layout of the piping, prevents heat deterioration of oil in the piping, facilitates securing of sealing, and prevents reduction of discharge of the pump caused by rise in temperature.

Though the oil pump for the power steering system is disposed above one of the cylinder banks which is positioned where the engine cover is higher, the rear cylinder bank in this particular embodiment, one or more auxiliary mechanisms driven by the engine output shaft other than the oil pump may be disposed above the cylinder bank where the engine cover is higher. For example, the positions of the oil pump 13 for the power steering system and the alternator 12 may be interchanged with each other as shown in FIG. 4.

Figure 4:
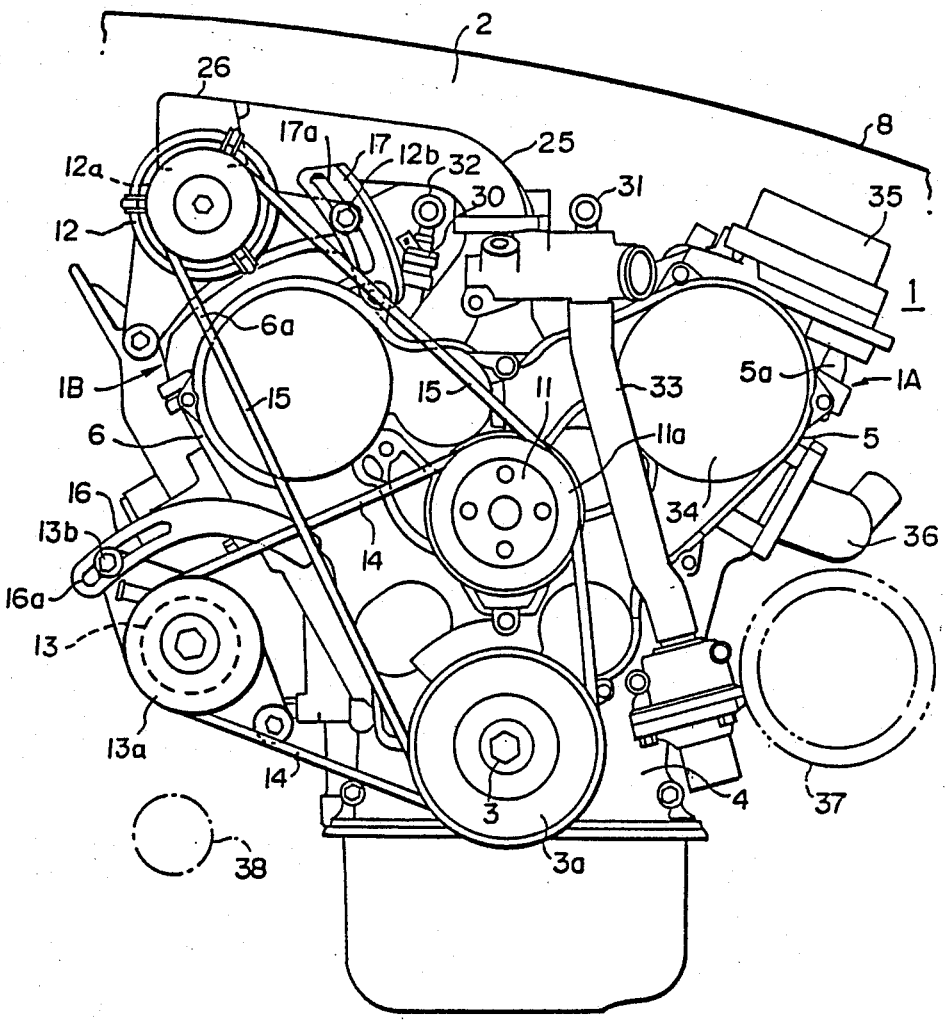
FIG. 4 is a view similar to FIG. 1 but showing another embodiment of the present invention.

In view of the fact that the power steering system is generally subjected to sharp change in load, and accordingly, the tension of the belt for the oil pump must be frequently adjusted, the embodiment shown in FIGS. 1 to 3 is preferable to that shown in FIG. 4. On the other hand, in view of the fact that the alternator is larger than the oil pump for the power steering system, the embodiment shown in FIG. 4 is preferable to that shown in FIGS. 1 to 3 from the viewpoint of better utilization of space.

I claim:

1. A V-type engine mounted in an engine compartment of a vehicle body such that an engine output shaft extends substantially in the transverse direction of said vehicle body, said engine compartment being provided at the front of said vehicle body and having a top wall defined by a cover member generally inclined downward from the rear of said engine compartment in the longitudinal direction of said vehicle body to the front of said vehicle body, at least above said engine, comprising:

front and rear cylinder banks, each of said banks having a plurality of cylinders, said cylinder banks being disposed substantially in parallel with said engine output shaft, a surge tank located directly atop said rear cylinder bank, said surge tank being connected to said cylinders of each said cylinder bank by a plurality of intake passages; and at least a first auxiliary mechanism, said first auxiliary mechanism disposed directly atop said rear cylinder bank in spaced relationship with said surge tank in the direction of the longitudinal axis of said engine output shaft, said first auxiliary mechanism being driven from an end of said engine output shaft via a driving force transmission means.

2. A V-type engine as defined in claim 1 in which said surge tank and said first auxiliary mechanism are substantially aligned in parallel with the longitudinal axis of said engine output shaft.

3. A V-type engine as defined in claim 1 in which said surge tank pens to the atmosphere by way of an upstream side intake passage connected to said surge tank at the end thereof opposite to said first auxiliary mechanism.

4. A V-type engine as defined in claim 1 in which said rear cylinder bank is displaced with respect to said front cylinder bank in the direction of the longitudinal axis of said engine output shaft toward said end of said engine output shaft from which said first auxiliary mechanism is driven.

5. A V-type engine as defined in claim 1 in which said driving force transmission means includes an engine output shaft pulley, a first driving pulley for driving said first auxiliary mechanism, and a belt passed round said engine output shaft pulley and said first driving pulley.

6. A V-type engine as defined in claim 5 in which said first auxiliary mechanism is an alternator.

7. A V-type engine as defined in claim 5, in which said first auxiliary mechanism is an oil pump for driving a power steering system.

8. A V-type engine as defined in claim 7 in which auxiliary mechanisms in addition to said first auxiliary mechanism are vertically disposed lower than said first auxiliary mechanism at the same end of said cylinder banks as said first auxiliary mechanism.

9. A V-type engine as defined in claim 5 in which said driving force transmission means further includes a second driving pulley for driving a water pump, said belt further passed around said second driving pulley.

10. A V-type engine as defined in claim 5 in which said first auxiliary mechanism is provided with a mechanism for changing the mounting position thereof to adjust the tension of said belt.

11. A V-type engine as defined in claim 10, in which said first auxiliary mechanism is an oil pump for driving a power steering system.

* * * * *